US007446707B2

(12) United States Patent
Poe et al.

(10) Patent No.: US 7,446,707 B2
(45) Date of Patent: Nov. 4, 2008

(54) ULTRA-LOW PROFILE VEHICULAR ANTENNA METHODS AND SYSTEMS

(75) Inventors: Gregory Poe, Chepachet, RI (US); Nick Haller, Middletown, NJ (US)

(73) Assignee: Micro-Ant, Inc., Fall River, MA (US)

( * ) Notice: Subject to any disclaimer, the term of this patent is extended or adjusted under 35 U.S.C. 154(b) by 0 days.

(21) Appl. No.: 11/131,440

(22) Filed: May 17, 2005

(65) Prior Publication Data

US 2005/0280581 A1 Dec. 22, 2005

Related U.S. Application Data

(63) Continuation-in-part of application No. 11/106,018, filed on Apr. 14, 2005, now abandoned.

(60) Provisional application No. 60/571,725, filed on May 17, 2004, provisional application No. 60/562,857, filed on Apr. 16, 2004.

(51) Int. Cl.
*H01Q 1/38* (2006.01)

(52) U.S. Cl. ..... 343/700 MS

(58) Field of Classification Search ..... 343/700 MS; 34/850

See application file for complete search history.

(56) References Cited

U.S. PATENT DOCUMENTS 5,376,942 A * 12/1994 Shiga ..... 343/700 MS
5,585,806 A * 12/1996 Ogino et al. ..... 343/700 MS
6,023,245 A * 2/2000 Gomez et al. ..... 343/725
6,087,990 A * 7/2000 Thill et al. ..... 343/700 MS
2003/0197651 A1* 10/2003 Yuanzhu ..... 343/725
2005/0195115 A1* 9/2005 Yegin et al. ..... 343/713
2006/0055601 A1* 3/2006 Kameda et al. ..... 343/700 MS
2006/0273969 A1* 12/2006 Aminzadeh et al. ..... 343/713
2007/0109209 A1* 5/2007 Winter ..... 343/719

FOREIGN PATENT DOCUMENTS

JP 9205305 A * 8/1997

OTHER PUBLICATIONS

Google, "Patch Antenna—Google Search", Internet search result pages from a Google search for "patch antenna", (Sep. 4, 2006), pp. 1-2.

Wikipedia, "Microstrip Antenna", Information on the general construction of a patch antenna, (Aug. 1, 2006), p. 1.

"Translation of Japanese Pub'd App'n No. 9-205305", Japanese Laid-Open Patent No. 9-205305,(Aug. 5, 1997).

* cited by examiner

*Primary Examiner*—Trinh V Dinh
(74) *Attorney, Agent, or Firm*—Strategic Patents, P.C.

(57) ABSTRACT

A method and system of providing an antenna for a communication system is provided that has a LNA mounted above the modular patch antenna. The resulting SDARS antenna has an ultra-low profile providing a more acceptable size for the user while maintaining the antenna gain requirements.

20 Claims, 4 Drawing Sheets

ULTRA-LOW PROFILE VEHICULAR ANTENNA METHODS AND SYSTEMS

RELATED APPLICATIONS

This application is a continuation-in-part of U.S. application Ser. No. 11/106,018, filed Apr. 14, 2005 and entitled "Low-Profile Unbalanced Vehicular Antenna Methods and Systems," which claimed the benefit of U.S. Prov. App. No. 60/562,857, filed Apr. 16, 2004.

This application also claims the benefit of U.S. Prov. App. No. 60/571,725, filed May 17, 2004 and entitled "Ultra-Low Profile Vehicular Antenna Methods and Systems."

Each of the above-referenced applications is incorporated herein by reference in its entirety.

BACKGROUND

1. Field

This invention relates to the methods and systems for a modular patch antenna and more particularly, embodiments of the present invention relate to the field of providing an ultra-low profile antenna for satellite radio transmissions.

2. Description of the Related Art

Satellite Digital Audio Radio Services (SDARS) antennas receive satellite and terrestrial transmissions and are typically connected to a receiver adapted to process the transmissions. SDARS antennas may be mounted on a user's vehicle and may receive audio and data content. For proper operation the SDARS antenna may be mounted on a high point of the vehicle, typically the roof, providing an unobstructed view of the sky and resulting in the antenna being plainly visible on the outside of the vehicle.

The typical design for a SDARS antenna has the modular patch antenna as the upper member of an antenna assembly mounted on top of electronic components for the antenna. Electronic components include a low noise amplifier (LNA) that may boost the received signal prior to the signal being used by a receiver. This design allows for the modular patch antenna to have an unobstructed view of the sky. The LNA needs proper shielding for high performance operation and therefore may require extra space between the LNA and the modular patch antenna. Magnets can be used as a mounting device for the SDARS antenna to secure the antenna assembly to a platform such as a vehicle.

The electronic components, such as an LNA, any shielding that may be required for electronic components, and the thickness of the modular patch antenna may provide a significant height to the design, requiring a relatively large covering housing or radome. With the covering radome, this design may result in a significantly large assembly that may not be preferred by some users. Accordingly, a need exists for a SDARS antenna that has an ultra-low profile, providing a more visually acceptable shape while still maintaining gain specifications for satellite radio transmissions.

SUMMARY

An aspect of the present invention relates to systems and methods for providing ultra-low profile satellite radio antenna. In embodiments, the systems and methods may involve a modular patch antenna for receiving satellite transmissions; and positioning a low noise amplifier (LNA) mounted on top of the modular patch antenna. The systems and methods may involve providing an ultra-low profile radome that may contain the LNA and the modular patch antenna. The ultra-low profile radome may be an over-mold of the LNA and the modular patch antenna. Mounting magnets may be provided for the antenna attachment to a mobile platform.

In embodiments, the antenna may be adapted for a Satellite Digital Audio Radio Services (SDARS) system. The antenna may be adapted to receive satellite radio transmission.

In embodiments, a cable may be provided through the modular patch antenna to the LNA. The LNA may be mounted on top of the modular patch antenna maintaining the gain specifications of the SDAR system.

In an embodiment this invention may provide for mounting the LNA above the modular patch antenna while maintaining compliance with gain requirements for a SDARS antenna. With the LNA mounted above the modular patch antenna the overall profile of the antenna is much lower than in the conventional design. In such embodiments a coax cable may be required to connect to the LNA from the top of the antenna assembly. In an embodiment the coax cable may be routed from the top of the LNA through a hole that may be near the center of the modular patch antenna and out the bottom of the antenna assembly. This configuration may have the LNA offset from the center of the modular patch antenna to allow for an advantageous connection location for the LNA and the modular patch antenna using the coax cable center wire. In an embodiment the resulting antenna assembly with the LNA mounted on the top of the modular patch antenna may provide for efficient use of space and may result in an ultra-low profile antenna under 0.350 inches tall with a radome diameter of approximately 2 inches. The shape of the radome may be round, square, multi-sided polygon, or other shape that covers the antenna assembly.

BRIEF DESCRIPTION OF THE FIGURES

The invention may be understood by reference to the following figures.

DETAILED DESCRIPTION

Figure 1:
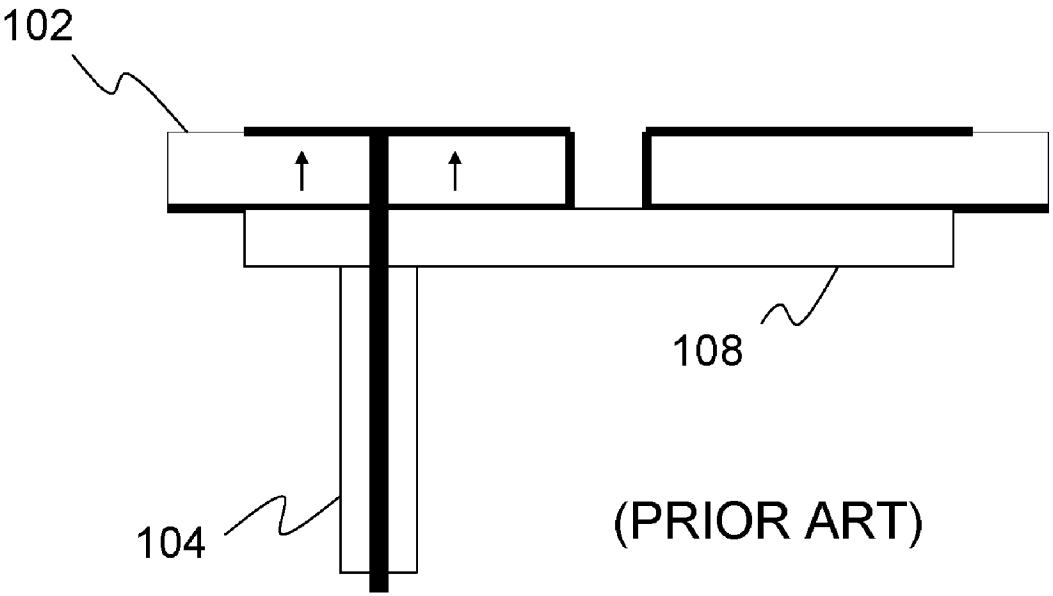
(PRIOR ART) Fig. 1
FIG. 1 shows the embodiment of the conventional configuration SDARS with LNA mounted under the modular patch antenna.

Referring to FIG. 1, an embodiment of a typical construction of a SDARS antenna is shown. To provide a clear view of the sky a modular patch antenna 102 may be mounted on top of a LNA 108 with a coax cable 104 connecting the modular patch antenna 102 and the LNA 104 from below the assembly. This configuration may allow for an unobstructed view of the sky for the modular patch antenna 102 to receive transmissions, but this construction may also provide a significant height. The LNA may require shielding to prevent interference signals. The shielding may require extra spacing between the modular patch antenna and the LNA. The combined height of the modular patch antenna, LNA and shielding may require a large covering radome that may not be aesthetically pleasing to the user.

Figure 2:
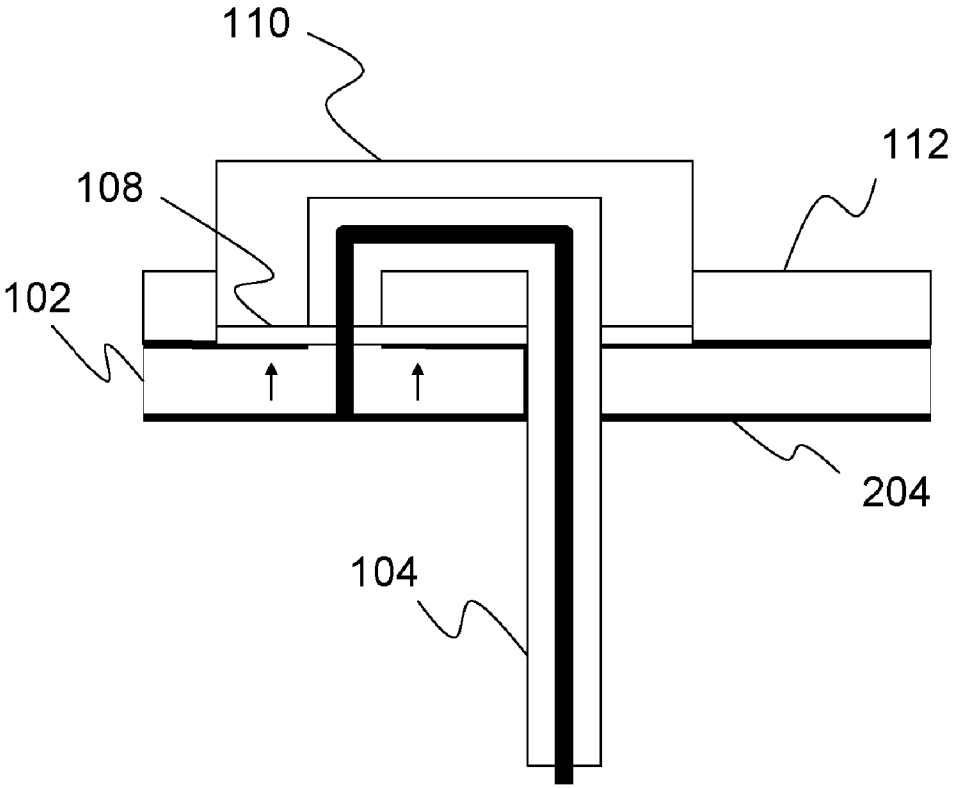
FIG. 2 shows the embodiment of the invention feeding the antenna coax cable through a hole that may be near the center of the patch antenna allowing the LNA to be mounted on top of the modular patch antenna.

FIG. 2 shows a simplified embodiment of the ultra-low profile antenna. An LNA 108 may be mounted on top of the modular patch antenna 102 and may utilize the available volume of the antenna assembly more efficiently. A typical LNA 108 may have a shielding cavity 110 enclosing the LNA 108 with the shielding space provided above the LNA 108 printed circuit board (PCB). The shielding space above the LNA 108 PCB may contribute to overall height of the antenna assembly when enclosed under a radome 112. The antenna may include a mounting magnet 204 for attaching the antenna to a mobile platform.

In an embodiment, the LNA 108 may be placed directly on the modular patch antenna 102. In an embodiment, the LNA may be placed with a space between the LNA 108 and the modular patch antenna 102. The placement of the LNA 108 above the modular patch antenna 102 may position the volume of the LNA 108 shielding cavity 110 above the modular patch antenna 102.

The radome 112 may provide a protective environment for the antenna assembly consisting of the LNA 108, the modular patch antenna 102, and associated electronics. In an embodiment, an ultra-low antenna profile may be provided by the radome 112 covering only the modular patch antenna 102 while the LNA 108 shielding cavity 110 may have a separate radome covering. The radome 112 may also be combined into a one piece radome 112 but may cover the LNA 108 and modular patch antenna 102 at the individual component heights. In an embodiment the radome 308 may be overmolded around the internal components. This may allow for a low cost hermetically sealed device. In an embodiment, by placing the LNA 108 above the modular patch antenna there may be an ultra-low contour shaped radome 112 covering the antenna assembly.

In an embodiment, the LNA 108 may be placed in any position on the top surface of the modular patch antenna 102. In an embodiment, the placement of the LNA 108 on the top surface of the modular patch antenna may allow for maintaining the gain specifications of the SDAR system.

A coax cable 104 may provide a connection between the LNA 108 and the modular patch antenna 102 for communication to a receiver. Access may be provided for the coax cable 104 to the top of the LNA 108 PCB; the coax cable 104 may be routed through the modular patch antenna 102 to the receiver. In an embodiment the modular patch antenna 102 and the LNA 108 may have a hole to provide access for the coax cable 104, from under the modular patch antenna 102, to connect to the top mounted LNA 108. In an embodiment, the modular patch antenna 102 coax cable access hole may be in the center of the modular patch antenna 102 or may be in another location on the modular patch antenna 102. In an embodiment the LNA 108 orientation to the modular patch antenna 102 may be offset from the modular patch antenna 102 access hole and may be determined by the design configuration of the LNA 108. In an embodiment the coax cable 104 may be routed through the modular patch antenna 102 access hole and the LNA 108 to provide a coax cable 104 connection to the LNA 108 PCB.

Figure 3:
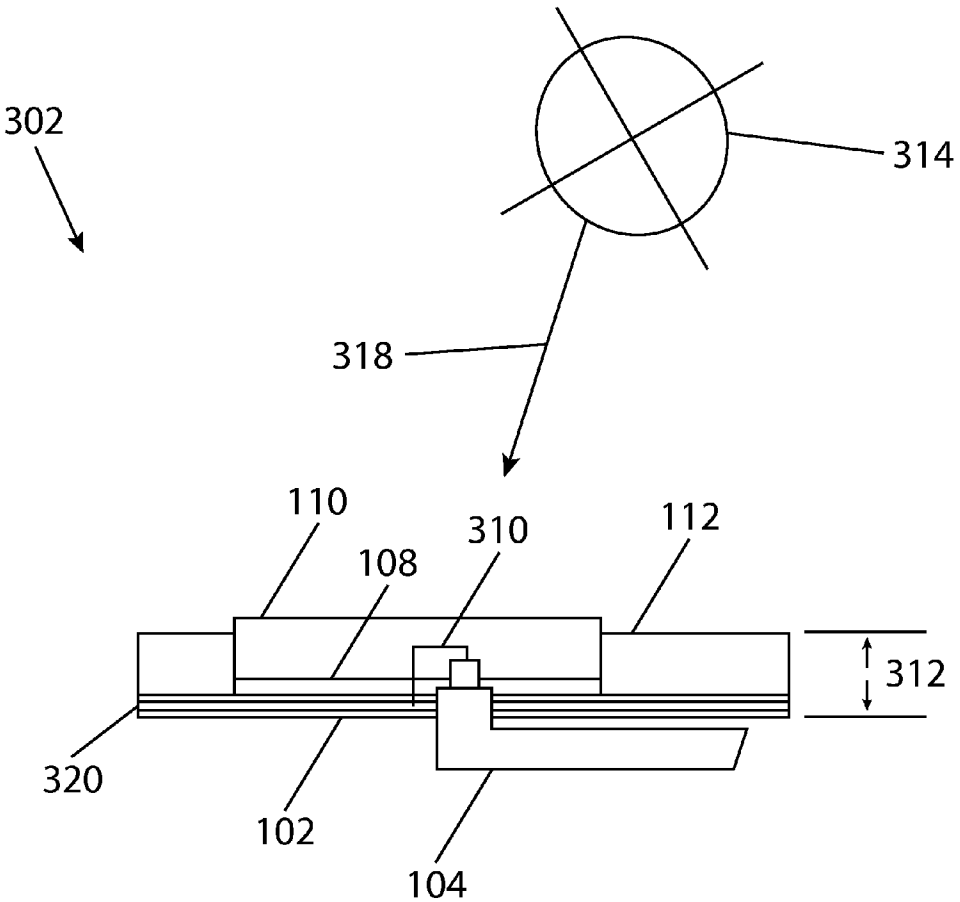
FIG. 3 shows a cross section of the ultra-low profile antenna assembly.

Referring to FIG. 3, an embodiment of a cross section of the ultra-low profile antenna 302 is shown. In an embodiment the LNA 108 may be mounted on top of the modular patch antenna 102 forming a very thin assembly. With the LNA 108 mounted on top of the modular patch antenna the satellite radio system (SDAR) gain specifications may still be satisfied. The SDAR may receive an incoming satellite signal 318 from a satellite 314 such that the incoming satellite signal 318 is received at the low noise amplifier 108 before reaching the modular patch antenna 102.

In an embodiment a coax cable 104 may access the assembly 302 through a hole in the modular patch antenna 102 and LNA 108 that may allow the coax cable 104 to access the LNA 108 from the bottom of the assembly. In an embodiment the center wire 310 of the coax cable 104 may make a connection to the LNA 108 and the modular patch antenna 102 at a unified location. In an embodiment the LNA 108 may be centered on the modular patch antenna 102 or the LNA 108 may be offset from the center of the modular patch antenna 102. The positioning of the LNA 108 on the modular patch antenna 102 may be dependent on the configuration of the LNA 108 printed circuit board and the location of the LNA 108 signal input. The LNA 108 may require a LNA shield cavity 110 that covers the LNA 108 and the LNA shield cavity 110 may be contained within the ultra-low profile antenna radome 112 as described in FIG. 2. In an embodiment the height requirements of the LNA shield 304 may be dependent on the design of the LNA 108. In an embodiment the radome 308 may be overmolded around the internal components. This may allow for a low cost hermetically sealed device. In an embodiment using a design such as described in FIG. 3 may result in an ultra-low profile antenna 302 that may have an overall height less then 0.350 inches 312.

Figure 4:
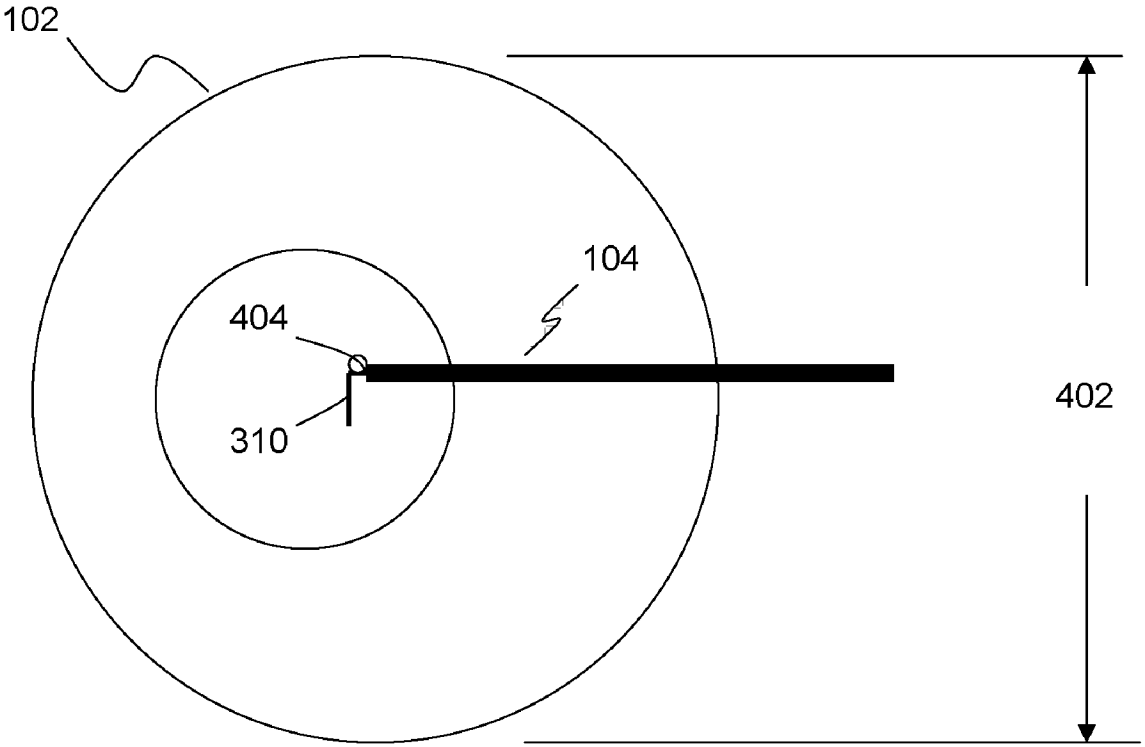
FIG. 4 shows a top view of the invention with the radome removed indicating a possible shape of the invention.

Referring to FIG. 4 the embodiment of the ultra-low profile antenna 302 top view is shown with the radome 112 removed. In this embodiment, the LNA 104 is shown mounted on top of the modular patch antenna 102 and offset from the center of the modular patch antenna 102. In an embodiment the coax cable 104 accesses the modular patch antenna 102 and LNA 104 from below the assembly through a hole 404 in the LNA 104 and the modular patch antenna 102. In an embodiment the center wire 310 from the coax cable 104 may be connected to the LNA 104 and the modular patch antenna 102 at a unified location and the connection location may be based on the design of the LNA 104. In an embodiment the center wire 310 from the coax cable 104 may be connected to the LNA 104, and a separate wire connects the input to the LNA to the modular patch antenna. In an embodiment the diameter of the modular patch antenna 102 may be approximately two inches 402 or other appropriate diameter and may be covered by the radome 112. In an embodiment the shape of the radome may be round, square, multi-sided polygon, or other shape that covers the antenna assembly.

In conventional SDARS antennas it is common to connect to the patch element of an antenna with a pin though the bottom of the patch. With the LNA 108 and other electronics positioned on top of the modular patch antenna 102 the modular patch antenna 102 is connected to the underlying substrate or ground plane, so the modular patch antenna 102 tends to be at ground. Therefore it may be desirable to drive the antenna to excite a field between the modular patch antenna 102 and the ground plane. The point at which an input to the electronics is taken from the modular patch antenna 102, such as the 50 Ohm point, may be modified based on the presence of the LNA 108 above the patch. Accordingly, the positioning of the LNA 108 and the positioning of the input from the modular patch antenna 102 should account for the presence of the LNA 108 above the modular patch antenna 102.

In embodiments, the LNA 108 may be supplied as a conventional LNA 108. In other embodiments the circuit board for the LNA 108 may actually be a metal element 320 (such as a copper metal element), where the circuit board simultaneously serves as the patch element 102 of the antenna.

The materials used to form the antennas described herein may include low cost materials.

In embodiments the LNA 108 and surrounding shield elements are offset relative to the center of the modular patch antenna 102. The positioning of the LNA 108 is preferably within a circle that defines a maximum outline of the LNA cavity. The positioning of the LNA 108 relative to the modular patch antenna 102 may affect the performance of the antenna, such as by increasing the gain at certain angles of elevation. In embodiments the patch is located so as to maximize the gain at elevation angles preferred for satellite radio systems, such as between twenty and ninety degrees elevation.

While the invention has been described in connection with certain preferred embodiments, other embodiments would be understood by one of ordinary skill in the art and are encompassed herein.

The invention claimed is:

1. A method of providing an antenna for a communications system, comprising:

providing a modular patch antenna for receiving satellite transmissions, the modular patch antenna formed of a metal patch element within a circuit board;

positioning a low noise amplifier (LNA) on top of the modular patch antenna relative to an incoming satellite signal with no intervening ground plane between the modular patch antenna and the LNA, wherein the incoming satellite signal arrives at the low noise amplifier before reaching the modular patch antenna; and electrically connecting the LNA to the modular patch antenna.

2. The method of claim 1, further comprising:

providing an ultra-low profile radome to contain the LNA and the modular patch antenna.

3. The method of claim 2 wherein the ultra-low profile radome is an over-mold of the LNA and the modular patch antenna.

4. The method of claim 1, further comprising:

providing mounting magnets for mounting the modular patch antenna to a mobile platform.

5. The method of claim 1, wherein the antenna is for a Satellite Digital Audio Radio Services (SDARS) system.

6. The method of claim 5 further comprising positioning the LNA to maintain a gain specification of the SDARS system.

7. The method of claim 1, wherein the antenna is adapted to receive a satellite radio transmission.

8. The method of claim 1 wherein electrically connecting the LNA to the modular patch antenna includes connecting the LNA to the modular patch antenna with a coaxial cable.

9. The method of claim 8 farther comprising routing the coaxial cable through the modular patch antenna.

10. The method of claim 8 farther comprising routing the coaxial cable to a receiver.

11. An antenna for a communications system, comprising:

a modular patch antenna for receiving satellite transmissions, the modular patch antenna formed of a metal patch element within a circuit board; and a low noise amplifier (LNA) electrically connected to the modular patch antenna and mounted on top of the modular patch antenna relative to an incoming satellite signal with no intervening ground plane between the modular patch antenna and the LNA, wherein the incoming satellite signal arrives at the low noise amplifier before reaching the modular patch antenna.

12. The antenna of claim 11, further comprising:

an ultra-low profile radome to contain the LNA and the modular patch antenna.

13. The antenna of claim 12 wherein the ultra-low profile radome is an over-mold of the LNA and the modular patch antenna.

14. The antenna of claim 11, further comprising:

mounting magnets for attaching the modular patch antenna to a mobile platform.

15. The antenna of claim 11, wherein the antenna is for a Satellite Digital Audio Radio Services (SDARS) system.

16. The antenna of claim 11, wherein the antenna is adapted to receive a satellite radio transmission.

17. The antenna of claim 11 wherein the LNA is electrically connected to the modular patch antenna through a coaxial cable.

18. The antenna of claim 17 wherein the coaxial cable passes through the modular patch antenna.

19. The antenna of claim 17 further comprising a receiver, wherein the coaxial cable electrically connects the modular patch antenna and the LNA to the receiver.

20. The antenna of claim 11 wherein the LNA is mounted on top of the modular patch antenna in a position selected to maintain a gain specification of the SDARS system.

* * * * *